United States Patent [19]

Kelmanski

[11] 4,179,121

[45] Dec. 18, 1979

[54] TENNIS RACKET WITH ADJUSTABLE WEIGHT

[76] Inventor: Pedro Kelmanski, Buenos Aires, Argentina

[21] Appl. No.: 854,013

[22] Filed: Nov. 22, 1977

[51] Int. Cl.[2] ..... A63B 49/04

[52] U.S. Cl. ..... 273/73 R; 273/73 G

[58] Field of Search ..... 273/26 B, 29 A, 67 R, 273/72 R, 73 R, 73 C, 73 G, 73 H, 73 J, 79, 162 R, 81 A, 171, 194 B; 116/135; 177/206, 247, 250; 40/110, 491

[56] References Cited

U.S. PATENT DOCUMENTS

| | | | |
|---|---|---|---|
| 1,186,283 | 6/1916 | Coddington | 273/73 G X |
| 2,135,648 | 11/1938 | Stumpf | 273/162 R X |
| 2,155,830 | 4/1939 | Howard | 273/79 |
| 2,395,864 | 3/1946 | Geerlings et al. | 273/73 J |
| 2,546,140 | 3/1951 | Tynan et al. | 273/73 J |
| 2,644,689 | 7/1953 | Putnam | 273/79 |
| 2,950,919 | 8/1960 | Cadman | 273/171 |
| 3,133,735 | 5/1964 | Greenshields | 273/171 |
| 3,204,639 | 9/1965 | Kleffman | 116/135 X |
| 3,382,941 | 5/1968 | Novak | 177/250 X |
| 3,758,117 | 9/1973 | Harrison | 273/194 B |
| 4,027,881 | 6/1977 | Hufenus | 273/73 G X |

FOREIGN PATENT DOCUMENTS

| | | | |
|---|---|---|---|
| 974039 | 9/1950 | France | 273/73 J |

*Primary Examiner*—Richard J. Apley
*Attorney, Agent, or Firm*—Holman & Stern

[57] ABSTRACT

A tennis racket is provided with a mechanism for adjusting the position of the center of gravity of the racket. The racket handle carries a plate having an elongated slot extending axially of the handle. A small counterweight is mounted for movement along the slot to alter the position of the center of gravity and an adjustment screw and wing nut are carried by the counterweight to clamp it in position along the slot.

3 Claims, 3 Drawing Figures

TENNIS RACKET WITH ADJUSTABLE WEIGHT

BACKGROUND OF THE INVENTION

The present invention refers to improvements in tennis rackets, of the type which have a counterweight movable along a guide on the handle to adjust the position of the racket's center of gravity.

Said characteristic of a variable counterweight gives the racket an unexpected effect, as it provides same with a perfect balance in accordance with the size, material used, etc., and especially in relation with each player so as to obtain a higher or lower weight in the principal structure of the netting in relation to the command grip.

It has previously been proposed, according to applicant's Argentine Pat. No. 198,361 for a counterweight to be set by screwing on a bolt extending in the longitudinal direction of the racket.

Although this system is efficient, in practice it evidences some problems: especially, the fact that being screwed on, every serve tends to move the counterweight, screwing and unscrewing it in relation to the function of each impulse, that is to say, displacing same on the stem.

This difficulty can be overcome, although based on the supply of means such as lock nuts or similar, in order to prevent the possibility of the aforesaid displacements.

Furthermore, the fact of having to handle nuts and lock nuts implies that the player must have special tools, for example, wrenches, which renders the system unpractical.

To the foregoing must also be added that the threading of the stem and the counterweight, as well as their assembly implies a relative complication of the system, increasing the production cost.

The improvement mentioned in the present specification, has solved and removed the above mentioned problems in an easy and ingenious manner, by placing a manually regulated counterweight on a guide, that is very simple and, nevertheless, positively effective, and that does not require the aid of tools for handling.

It is believed that this improvement shall have acceptance when put into practice as due to the characteristics that define same, the system can be applied to all kinds of rackets in general.

SUMMARY OF THE INVENTION

In a preferred embodiment, a tennis racket comprises a member bowed to form the head of the racket and two rods extending from the head to form the handle which terminates in a suitable grip.

The strings are anchored in an oval hoop that is tightly wedged in the head parts of the frame and which is detachable with respect to frame.

Said frame is completed by means of a complementary plate fixed between said rods that provides retention means of the hoop against the frame, and includes a slot on the longitudinal geometric axle of the racket in which a counterweight is mounted for displacement in the longitudinal direction of the slot to adjust the centre of gravity of the racket.

The handle is constituted by the two rods of the open frame that in one part are connected by the locking plate, and on the opposite end are removably inserted in the grip.

The counterweight comprises a small clamp that includes a bolt and adjustment wing nut that is slidably set in the elongated slot—slot on the handle, placed in the longitudinal geometric axle direction of the racket.

DESCRIPTION OF THE PREFERRED EMBODIMENT

In the different figures, the same reference numbers indicate similar or corresponding parts.

In general, (a) is the frame of the racket which has a head section 1' and a handle (b).

Said handle (b), comprises a set of rods 1, that on the one hand from the grip (not illustrated), and on the other fork cut to define the head 1' carries the strings 2, and against which (according to FIG. 1) rests the upper edge of a rigid plate 3 fitting between the rods 1 to which it is united.

Figure 1:
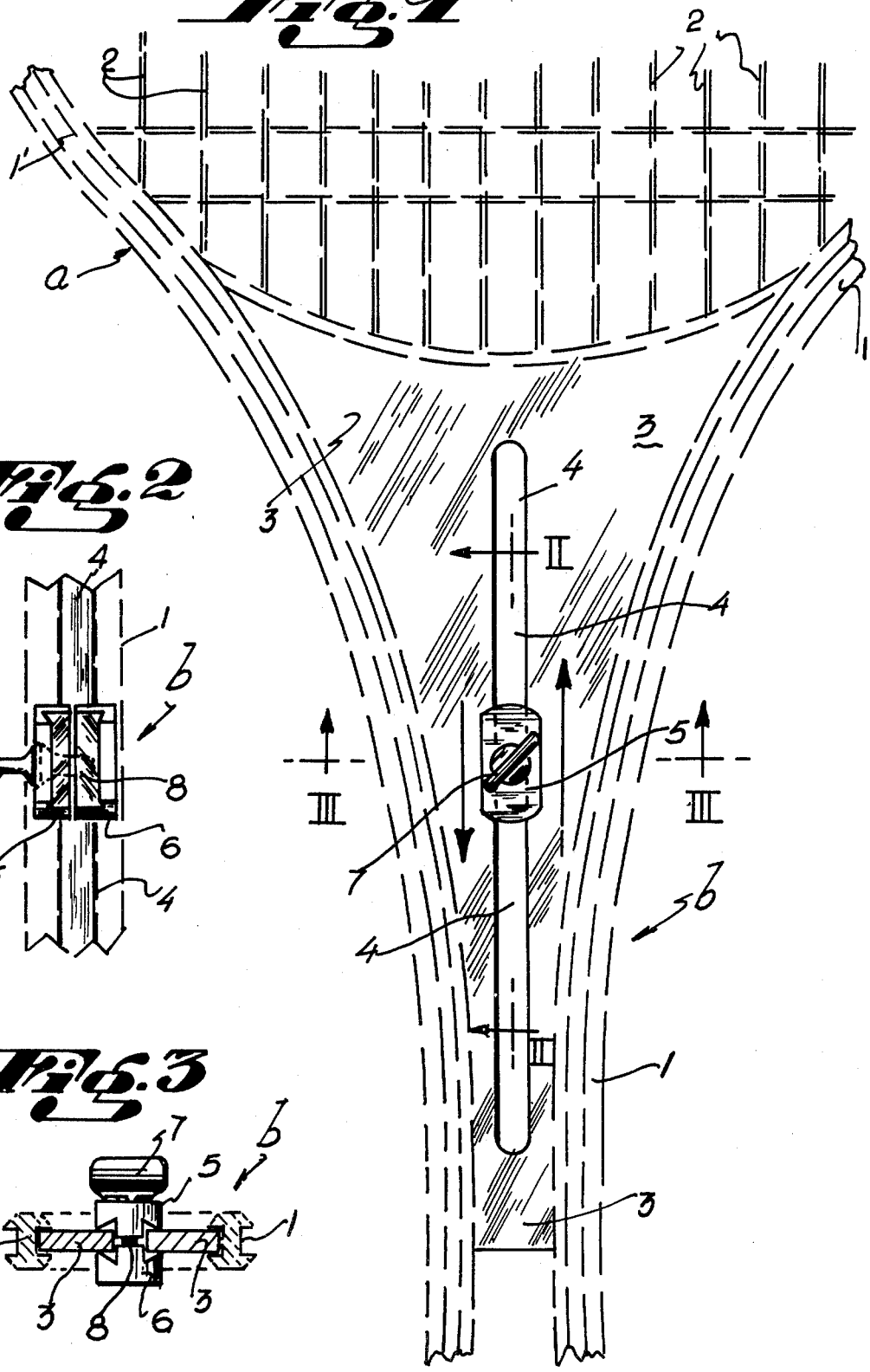
FIG. 1 represents a detail of the racket—in dash lines in the centre of the handle where the guide slot is observed, on which the small clamp is slidably mounted and adjusted by means of a wing nut; the possible displacement direction of said counterweight is pointed out by means of arrows.

Said rigid plate 3 has a slot 4, that is directed to coincide with the longitudinal geometric axis of the racket, and extends from the hoop (a) to lower portion of the handle (b) (FIG. 1).

Figure 2:
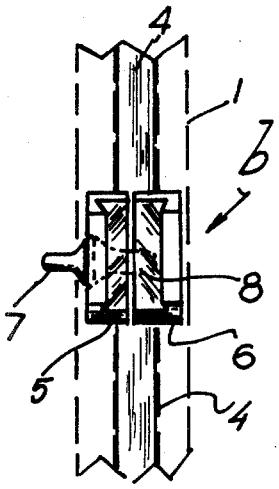
FIG. 2 is a longitudinal section of the racket on the II—II of FIG. 1 that illustrates how the small clamp of the counterweight works.
Figure 3:
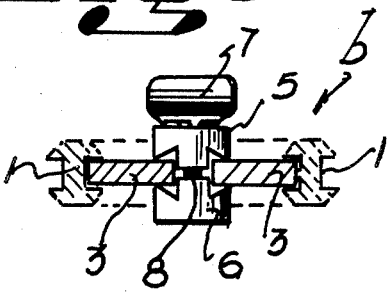
FIG. 3 is a cross section of the handle of the racket where the counterweight is set taken on line III—III of FIG. 1, and shows how it adjusts as a clamp in the guide.

In slot 4, the counterweight is mounted formed by a set of metal clamps 5 and 6, that may have the sections shown in FIGS. 2 and 3, and that are connected by means of a screw 8 that ends with a wing nut 7.

The system works in such a way that, according to the relative position adopted by the counterweight 5–6 along the slide 4, the centre of gravity of the racket varies correlatively.

It can be readily appreciated, particularly from FIG. 3 of the drawings, that tightening of the wing nut 7 causes the opposed clamps 5 and 6 tightly to grip sections of the plate 3 on opposite sides of the slot.

It is doubtless that in putting the present invention into practice, some modifications may be introduced as regards certain details in the construction and shape of the new racket, without this involving a departure from the basic principles which are clearly specified in the following claims.

Having thus especially described and determined the nature of the present invention and the manner in which same shall be put into practice, I hereby claim as my exclusive right and property:

1. A tennis racket comprising a racket head and a racket handle extending from said head toward a grip remote from said head, said handle including a flat member defining a longitudinal slot substantially aligned with the longitudinal axis of the handle and a counterweight means movable along said slot for adjusting the position of the center of gravity of the racket, said counterweight means comprising a pair of clamps having edge portions engaging opposite surfaces of said flat member on opposite sides of said slot, screw means connecting said clamps for movement toward and away from each other, and means for rotating said screw means by thumb and finger pressure, said edge portions of said clamps being tightened against said opposite surfaces of said flat member by tightening said screw means and said counterweight means being movable along said slot by loosening said screw means.

2. The tennis racket of claim 1 wherein said means for rotating said screw means is a wing nut.

3. The tennis racket of claim 1 wherein said handle comprises a pair of rods extending from the racket head and said flat member is a plate fixed between said rods.

* * * * *